US011780628B1

(12) United States Patent
Bison

(10) Patent No.: US 11,780,628 B1
(45) Date of Patent: Oct. 10, 2023

(54) ENCODER MOUNT FOR A PALLET WRAPPING SYSTEM

(71) Applicant: Darrel Bison, Phoenix, AZ (US)

(72) Inventor: Darrel Bison, Phoenix, AZ (US)

( * ) Notice: Subject to any disclaimer, the term of this patent is extended or adjusted under 35 U.S.C. 154(b) by 0 days.

(21) Appl. No.: 17/570,274

(22) Filed: Jan. 6, 2022

(51) Int. Cl.
*B65B 11/02* (2006.01)
*B65B 57/02* (2006.01)
*B65B 11/00* (2006.01)

(52) U.S. Cl.
CPC ..... *B65B 57/02* (2013.01); *B65B 11/02* (2013.01); *B65B 2011/002* (2013.01)

(58) Field of Classification Search
None
See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |
| 2,026,282 | A | 12/1935 | Leguillon |
| 2,823,530 | A | 2/1958 | Rikard |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover |
| 4,172,608 | A | 10/1979 | Brown, Jr. |
| 4,235,062 | A | 11/1980 | Lancaster, III |
| 4,255,918 | A | 3/1981 | Lancaster |
| 4,353,515 | A | 10/1982 | Weaver |
| 4,369,614 | A | 1/1983 | Tetzner |
| 4,409,776 | A | 10/1983 | Usui |
| 4,468,922 | A | 9/1984 | McCrady |
| 4,530,473 | A | 7/1985 | Parry |
| 4,619,102 | A | 10/1986 | Geisinger |
| 4,671,043 | A | 6/1987 | Forni |

(Continued)

FOREIGN PATENT DOCUMENTS

| | | |
|---|---|---|
| DE | 3933952 C1 | 5/1990 |
| DE | 19505240 | 3/1996 |

(Continued)

OTHER PUBLICATIONS

JPO machine translation of JP 10-129609 A, Aug. 14, 2013 4 pages.

(Continued)

*Primary Examiner* — Tanzim Imam
(74) *Attorney, Agent, or Firm* — Booth Udall Fuller, PLC; Kenneth C. Booth

(57) ABSTRACT

A pallet wrapping system with a pre-stretch carriage and at least two encoders. The pre-stretch carriage is configured to pre-stretch stretch film and has at least two stretch rollers and a hinged door. The at least two stretch rollers includes a first stretch roller with an outer surface that moves at a first speed and a second stretch roller with an outer surface that moves at a second speed higher than the first speed. The door provides access to the stretch rollers when in an open position and entraps the stretch film between the stretch rollers and the door when in a closed position. The encoders are mounted on the door. Each of the encoders is configured to contact the stretch film on the outer surface of one of the stretch rollers and measure a length of stretch film passing over that stretch roller.

19 Claims, 6 Drawing Sheets

(56) References Cited

U.S. PATENT DOCUMENTS

| | | | |
|---|---|---|---|
| 4,723,393 | A | 2/1988 | Silbernagel |
| 4,739,945 | A | 4/1988 | Yokoe |
| 4,754,594 | A | 7/1988 | Lancaster |
| 4,807,427 | A | 2/1989 | Casteel |
| 4,827,700 | A | 5/1989 | Rampe |
| 4,845,920 | A | 7/1989 | Lancaster |
| 4,905,448 | A | 3/1990 | Plitt |
| 4,905,451 | A | 3/1990 | Jaconelli |
| 4,961,306 | A | 10/1990 | Sawhney |
| 5,031,771 | A | 7/1991 | Lancaster |
| 5,079,898 | A | 1/1992 | Springs |
| 5,107,657 | A | 4/1992 | Diehl |
| 5,125,209 | A | 6/1992 | Thimon |
| 5,168,685 | A | 12/1992 | Suzuki |
| 5,195,297 | A | 3/1993 | Lancaster |
| 5,203,939 | A | 4/1993 | Sperling |
| 5,211,353 | A | 5/1993 | Lewin |
| 5,307,609 | A | 5/1994 | Kurata |
| 5,315,808 | A | 5/1994 | MacIvor |
| 5,358,594 | A | 10/1994 | Darrieux |
| 5,385,001 | A | 1/1995 | Ramer |
| 5,409,177 | A | 4/1995 | Parry |
| 5,447,009 | A | 9/1995 | Oleksy |
| 5,535,962 | A | 7/1996 | Bargowski |
| 5,561,971 | A | 10/1996 | Sampson |
| 5,653,293 | A | 8/1997 | Ellis |
| 5,797,246 | A | 8/1998 | Martin-Cocher |
| 5,819,503 | A | 10/1998 | Lancaster, III |
| 5,965,262 | A | 10/1999 | Whisler |
| 6,065,269 | A | 5/2000 | Malnati |
| 6,164,047 | A | 12/2000 | Rossi |
| 6,311,459 | B1 | 11/2001 | Rossi |
| 6,393,808 | B1 | 5/2002 | Kallner |
| 6,688,076 | B1 | 2/2004 | Rivera, Jr. |
| 6,745,544 | B2 | 6/2004 | Matsumoto |
| 6,775,956 | B1 | 8/2004 | Lacey |
| 6,796,105 | B2 | 9/2004 | Rossi |
| 6,883,298 | B2 | 4/2005 | Gooding |
| 6,892,515 | B2 | 5/2005 | Cere |
| 6,971,220 | B1 | 12/2005 | Rampp |
| 7,029,206 | B2 | 4/2006 | Stockstill |
| 7,269,935 | B2 | 9/2007 | Jafari |
| 7,581,368 | B1 | 9/2009 | Bison |
| 7,621,107 | B2 | 11/2009 | Vanderheiden |
| 7,908,831 | B1 | 3/2011 | Dugan |
| 8,046,975 | B1 | 11/2011 | Bison |
| 8,053,056 | B2 | 11/2011 | Heikaus |
| 8,276,349 | B2 | 10/2012 | Van Amstel |
| 8,528,615 | B2 | 9/2013 | Colson |
| 8,549,819 | B1 | 10/2013 | Bison |
| 8,637,134 | B1 | 1/2014 | Aronsen |
| 8,707,664 | B1 | 4/2014 | Bison |
| 10,279,945 | B2 | 5/2019 | Nelson |
| 2004/0244336 | A1 | 12/2004 | Suolahti |
| 2005/0123721 | A1 | 6/2005 | Heikaus |
| 2008/0066431 | A1 | 3/2008 | Cousins |
| 2008/0092489 | A1 | 4/2008 | Smith |
| 2008/0209859 | A1 | 9/2008 | Vanderheiden |
| 2009/0277136 | A1 | 11/2009 | Van Amstel |
| 2009/0293425 | A1* | 12/2009 | Carter ..... B65B 11/025 53/167 |
| 2011/0088359 | A1 | 4/2011 | Brocard |
| 2012/0102887 | A1* | 5/2012 | Lancaster, III ..... B65B 11/025 73/788 |
| 2013/0104754 | A1 | 5/2013 | Van Amstel |
| 2014/0331609 | A1 | 11/2014 | Bison |
| 2015/0353220 | A1* | 12/2015 | Lancaster, III ..... B65B 57/18 53/461 |
| 2017/0101205 | A1* | 4/2017 | Schieck ..... B65B 11/025 |
| 2018/0257799 | A1* | 9/2018 | Ragsdale ..... B65B 11/045 |
| 2019/0084703 | A1 | 3/2019 | Nicholson |
| 2020/0299016 | A1* | 9/2020 | Lancaster, III ..... B65B 11/025 |
| 2020/0377250 | A1* | 12/2020 | Lancaster, III ..... B65H 23/185 |

FOREIGN PATENT DOCUMENTS

| | | | |
|---|---|---|---|
| EP | 0178145 | A1 | 4/1986 |
| EP | 1332968 | A1 | 8/2003 |
| EP | 1803345 | A1 | 7/2007 |
| EP | 2589540 | A1 | 5/2013 |
| EP | 3070003 | A1 | 9/2016 |
| GB | 2241484 | A | 9/1991 |
| JP | H0245309 | | 2/1990 |
| JP | H04215903 | | 8/1992 |
| JP | H04327108 | | 11/1992 |
| JP | H10129609 | | 5/1998 |
| JP | 10129609 | A | 5/1999 |
| JP | 2000302102 | A | 10/2000 |
| JP | 2002166905 | A | 6/2002 |
| JP | 2002211502 | A | 7/2002 |
| JP | 2002225806 | A | 8/2002 |
| JP | 2002225807 | A | 8/2002 |
| WO | 9012737 | A1 | 11/1990 |
| WO | 2009155713 | A2 | 12/2009 |

OTHER PUBLICATIONS

JPO machine translation of JP 2002-225806 A, Aug. 14, 2013 15 pages.

USPTO translation of JP 2-45309 A, Aug. 13, 2013 7 pages.

* cited by examiner

ENCODER MOUNT FOR A PALLET WRAPPING SYSTEM

TECHNICAL FIELD

Aspects of this document relate generally to pallet wrapping systems with pre-stretch carriages, and more specifically to pallet wrapping systems using encoders to track stretch film usage.

BACKGROUND

Pallets are commonly wrapped in stretch film to provide stability and protection to palletized loads during transit. An important aspect of wrapping palletized loads efficiently is monitoring stretch film usage per pallet. One method of monitoring stretch film usage is to measure the revolutions of the roller pulling the stretch film off of the spool. Such a method is less reliable because the stretch film sometimes slips against the roller. Another method of monitoring stretch film usage is to measure a length of stretch film that is removed from the pre-stretch carriage. To do so, the sensor is often placed on the outside surface of the roll of stretch film on the spool and spring-loaded to maintain contact with the outside surface as the roll of stretch film becomes smaller. This method is more accurate but meets other challenges. For example, the sensor must be reset each time the roll of stretch film is replaced, which increases the likelihood of user error. Additionally, the sensor sometimes moves into place before a roll of stretch film is placed on the spool. If the user fails to notice that this has occurred, a roll of stretch film may be placed onto the spool with the sensor in the way, causing damage to the sensor.

SUMMARY

Aspects of this document relate to a pallet wrapping system comprising a pre-stretch carriage configured to pre-stretch stretch film, the pre-stretch carriage having at least two driven stretch rollers including a first driven stretch roller with an outer surface configured to move at a first speed and a second driven stretch roller with an outer surface configured to move at a second speed higher than the first speed, and a hinged door configured to provide access to the at least two driven stretch rollers when in an open position and entrap the stretch film between the at least two driven stretch rollers and the hinged door when in a closed position, and at least two encoders including a first encoder and a second encoder mounted on the hinged door, wherein the first encoder is configured to contact the stretch film on the outer surface of the first driven stretch roller when the hinged door is in the closed position and measure a length of stretch film passing over the first driven stretch roller, and wherein the second encoder is configured to contact the stretch film on the outer surface of the second driven stretch roller when the hinged door is in the closed position and measure a length of stretch film passing over the second driven stretch roller.

Particular embodiments may comprise one or more of the following features. The first driven stretch roller may have a diameter smaller than a diameter of the second driven stretch roller. The first driven stretch roller may have a diameter equal to a diameter of the second driven stretch roller. The first encoder may be configured to rotate when the stretch film passes over the first driven stretch roller, and the second encoder may be configured to rotate when the stretch film passes over the second driven stretch roller.

Aspects of this document relate to a pallet wrapping system comprising a pre-stretch carriage configured to pre-stretch stretch film, the pre-stretch carriage having at least two driven stretch rollers including a first driven stretch roller with an outer surface configured to move at a first speed and a second driven stretch roller with an outer surface configured to move at a second speed higher than the first speed, and a door configured to provide access to the at least two driven stretch rollers when in an open position and entrap the stretch film between the at least two driven stretch rollers and the door when in a closed position, and at least two encoders including a first encoder and a second encoder mounted on the door, wherein the first encoder is configured to measure a length of stretch film passing over the first driven stretch roller while the door is in the closed position, and wherein the second encoder is configured to measure a length of stretch film passing over the second driven stretch roller while the door is in the closed position.

Particular embodiments may comprise one or more of the following features. Each of the at least two encoders may be movable towards and away from the door and may be biased away from the door. The first encoder may be configured to contact the stretch film on the outer surface of the first driven stretch roller when the door is in the closed position. The second encoder may be configured to contact the stretch film on the outer surface of the second driven stretch roller when the door is in the closed position. The first driven stretch roller may have a diameter smaller than a diameter of the second driven stretch roller. The first driven stretch roller may have a diameter equal to a diameter of the second driven stretch roller. The first encoder may be configured to rotate when the stretch film passes over the first driven stretch roller, and the second encoder may be configured to rotate when the stretch film passes over the second driven stretch roller.

Aspects of this document relate to a pallet wrapping system comprising a pre-stretch carriage configured to pre-stretch stretch film, the pre-stretch carriage having at least one stretch roller including a first stretch roller with an outer surface configured to move at a first speed, and a door configured to provide access to the at least one stretch roller when in an open position and entrap the stretch film between the at least one stretch roller and the door when in a closed position, and at least one encoder including a first encoder mounted on the door, wherein the first encoder is configured to measure a length of stretch film passing over the first stretch roller while the door is in the closed position.

Particular embodiments may comprise one or more of the following features. Each of the at least one encoder may be movable towards and away from the door and may be biased away from the door. The first encoder may be configured to contact the stretch film on the outer surface of the first stretch roller when the door is in the closed position. The first encoder may be configured to rotate when the stretch film passes over the first stretch roller. The at least one stretch roller may further include a second stretch roller with an outer surface configured to move at a second speed higher than the first speed. The first stretch roller may have a diameter smaller than a diameter of the second stretch roller. The first stretch roller may have a diameter equal to a diameter of the second stretch roller. The at least one encoder may further include a second encoder wherein the second encoder is configured to measure a length of stretch film passing over the outer surface of the second stretch roller while the door is in the closed position. The second encoder may be configured to contact the stretch film on the outer surface of the second driven stretch roller when the door is in the closed position.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
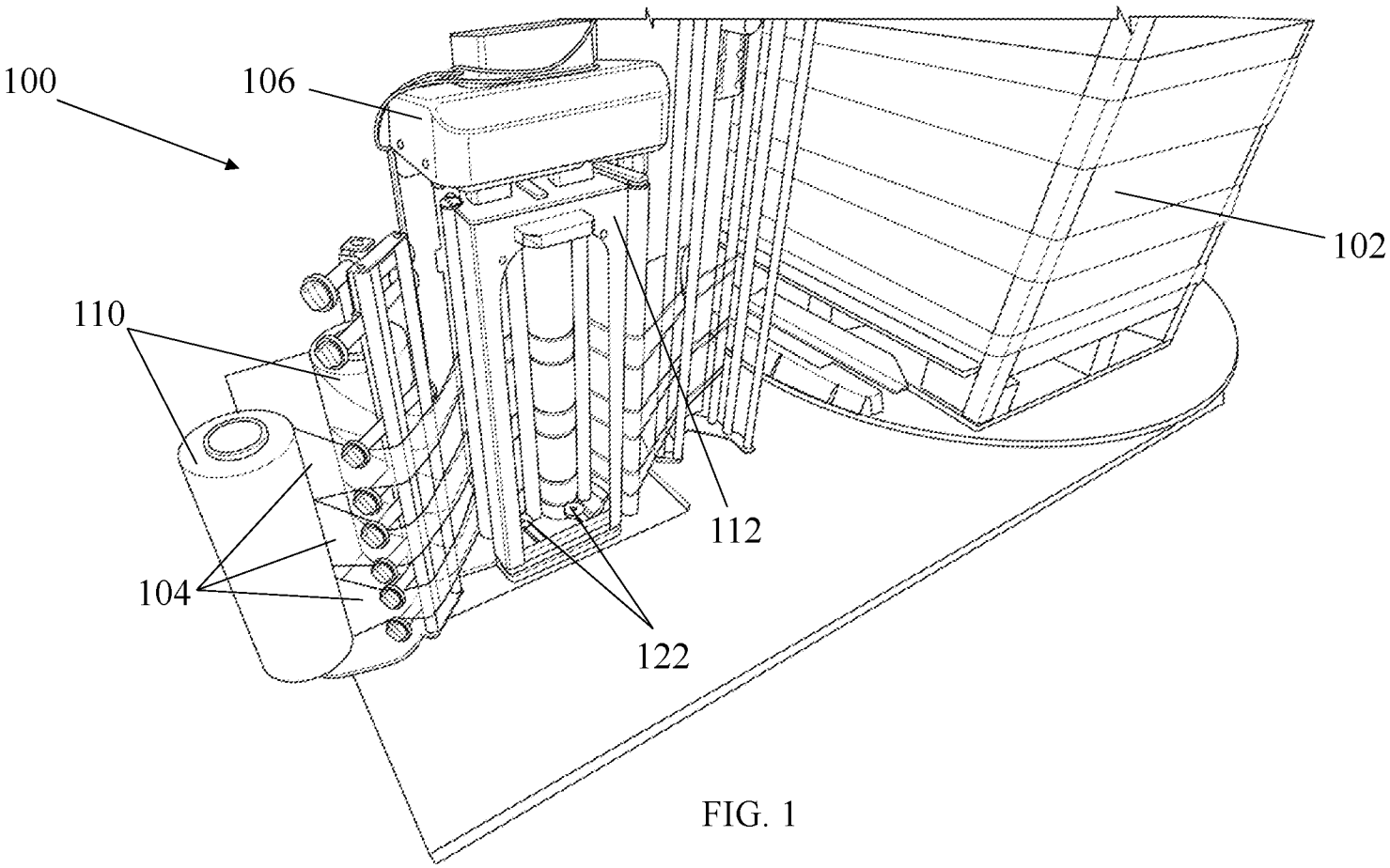
FIG. 1 is a perspective view of a pallet wrapping system including a pre-stretch carriage.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a pallet wrapping system 100 that is configured to wrap a palletized load 102 with stretch film 104. Additionally, the pallet wrapping system 100 is configured to accurately monitor stretch film usage in a way that limits user involvement. This allows accurate gathering of data to help reduce costs associated with wrapping palletized loads 102 with stretch film 104 without interfering with the operation of the pallet wrapping system 100.

Figure 2:
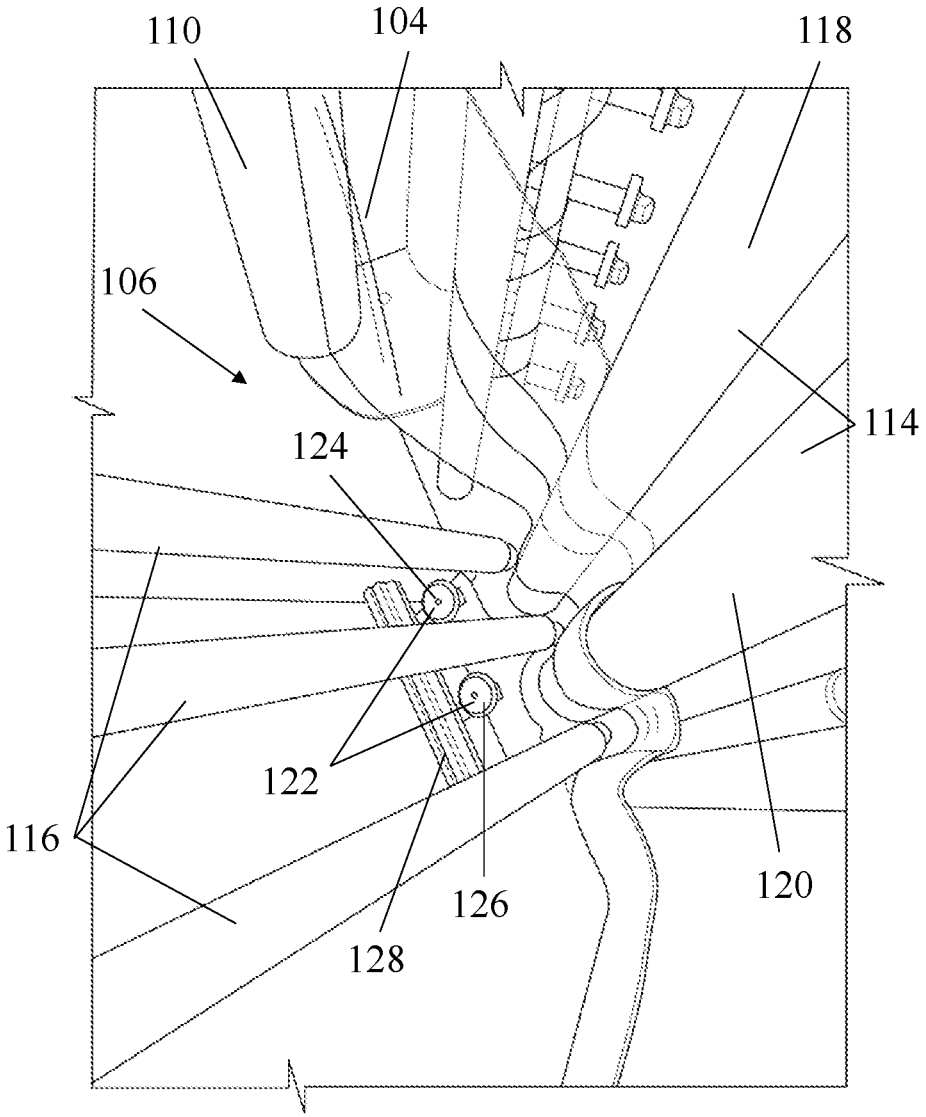
FIG. 2 is a close-up view of the pre-stretch carriage shown in FIG. 1 with the door open to show the interior.
Figure 3:
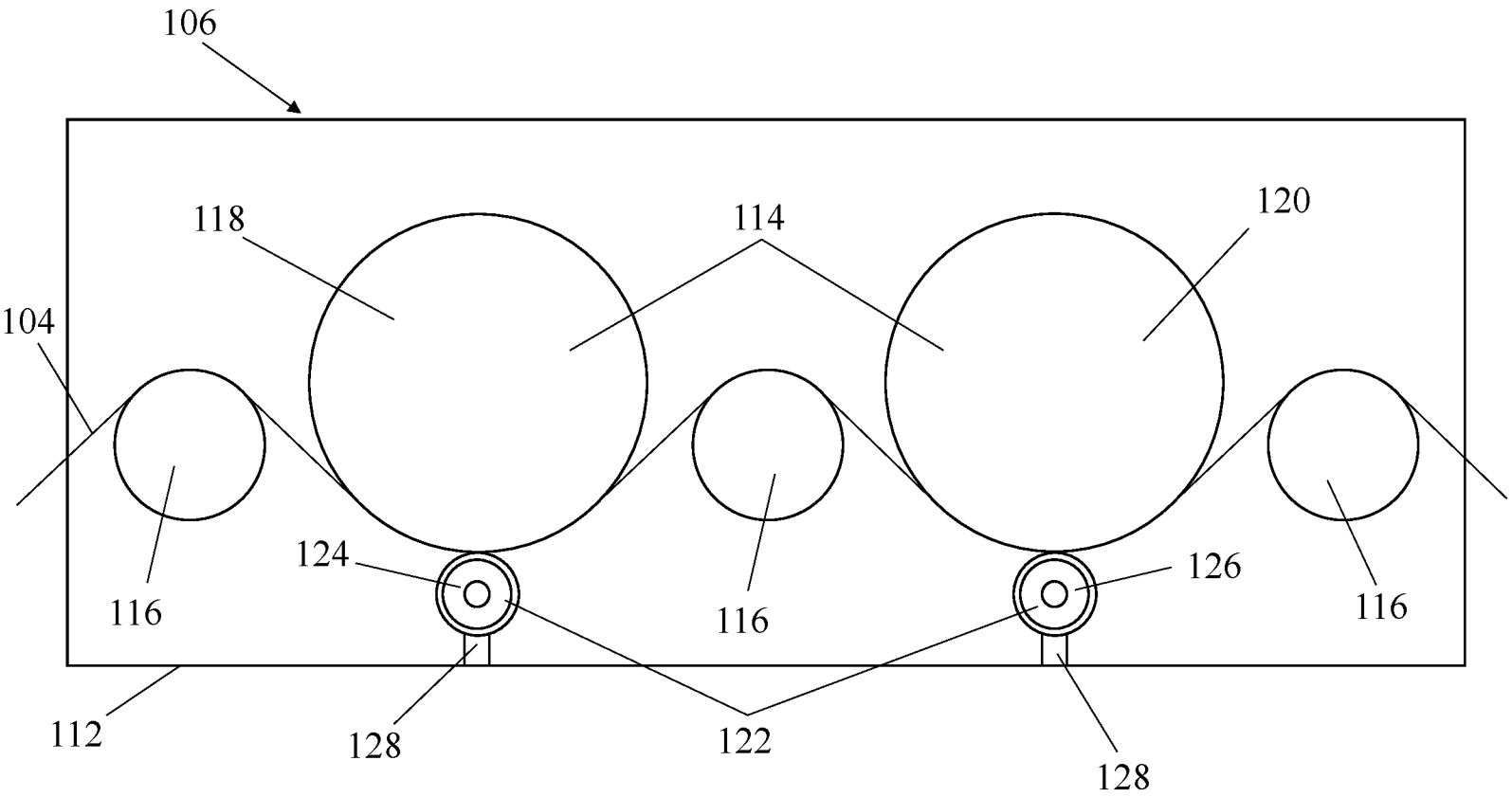
FIG. 3 is a top view of the interior of the pre-stretch carriage shown in FIG. 1 with the first stretch roller and second stretch roller having the same diameter.
Figure 4:
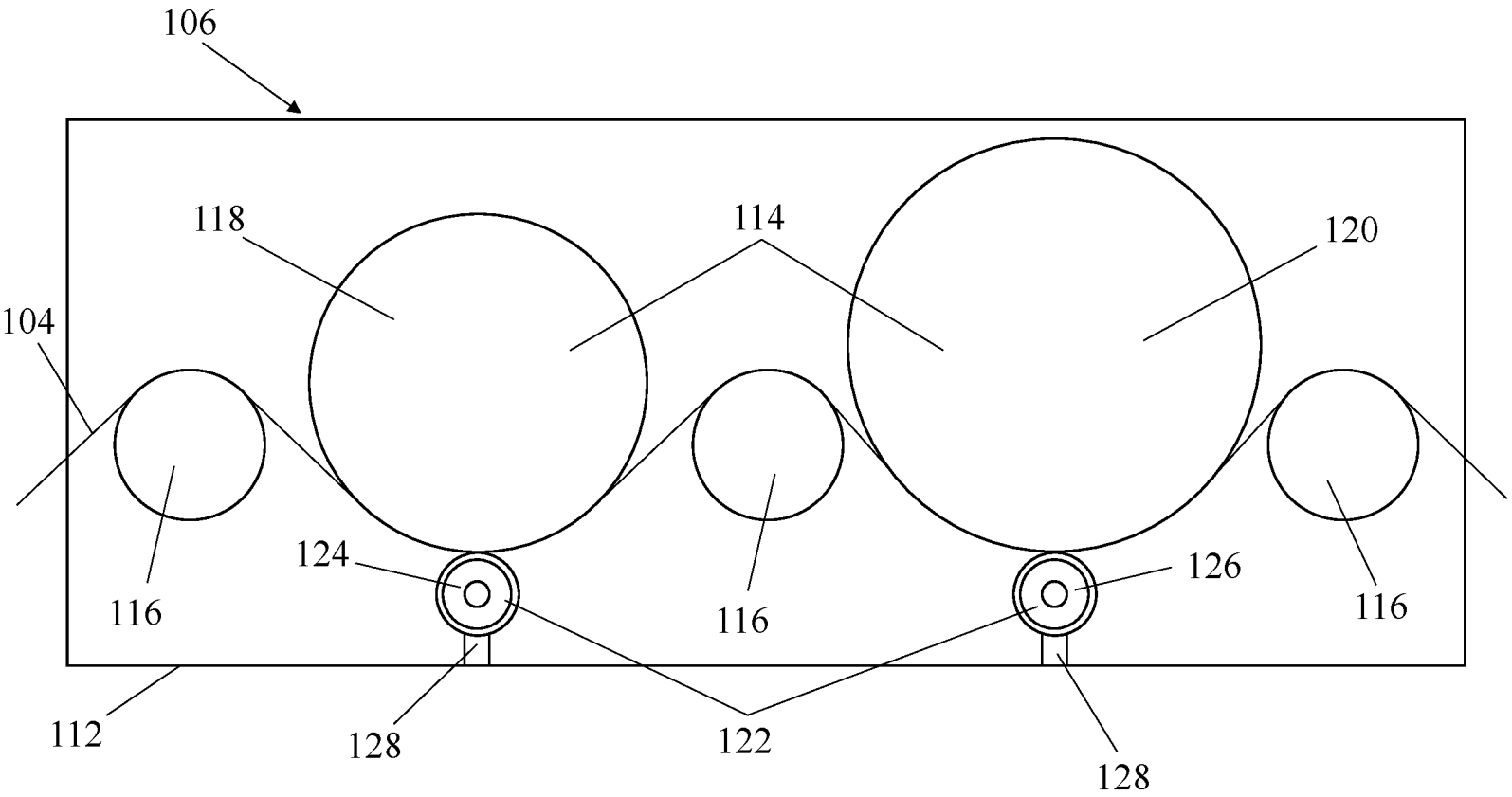
FIG. 4 is a top view of the interior of the pre-stretch carriage shown in FIG. 1 with the second stretch roller having a larger diameter than the first stretch roller.

The pallet wrapping system 100 comprises a pre-stretch carriage 106, as shown in FIG. 1. The pre-stretch carriage 106 is configured to pre-stretch the stretch film 104 being unrolled from a roll 110 of stretch film 104 before the stretch film 104 is wrapped around the palletized load 102. The pre-stretch carriage 106 may have a door 112, at least two stretch rollers 114, and a plurality of passive rollers 116 configured to pass stretch film 104 to and receive stretch film 104 from the stretch rollers 114, as shown in FIGS. 2-4. The at least two stretch rollers 114 are configured to grip the stretch film 104 to limit slipping between the stretch rollers 114 and the stretch film 104. Thus, design choices such as the material for the stretch rollers 114 and the arrangement of the stretch rollers 114 and the passive rollers 116 within the pre-stretch carriage 106 may be influenced by the goal of limiting slipping between the stretch rollers 114 and the stretch film 104. For example, the material from which the stretch rollers 114 are formed may be a material with a high coefficient of friction with stretch film 104. As another example, the plurality of passive rollers 116 may be positioned within the pre-stretch carriage 108 to increase the surface area over which the stretch film 104 is in contact with the stretch rollers 114. Thus, while FIGS. 3 and 4 show the passive rollers 116 and the stretch rollers 114 separated for illustrative purposes, the passive rollers 116 may be placed closer to the stretch rollers 114 and/or around the top of the stretch rollers 114 to increase the surface area over which the stretch film 104 is in contact with the stretch rollers 114. Additional passive rollers 116 may also be added to those shown in the figures to the same end.

The at least two stretch rollers 114 may include a first stretch roller 118 and a second stretch roller 120. The first stretch roller 118 may have an outer surface configured to move at a first speed while the second stretch roller 120 may have an outer surface configured to move at a second speed higher than the first speed. Thus, as the stretch film 104 moves through the pre-stretch carriage 106, the second stretch roller 120 pulls the stretch film 104 out of the pre-stretch carriage 106 faster than the first stretch roller 118 pulls the stretch film 104 into the pre-stretch carriage 106. This stretches the stretch film 104 between the first stretch roller 118 and the second stretch roller 120. The at least two stretch rollers 114 may be driven. For example, the at least two stretch rollers 114 may be operatively coupled to a motor or plurality of motors that drive the rotation of the stretch rollers 114. In such an embodiment, the stretch rollers 114 grip the stretch film 104 and pull the stretch film 104 through the pre-stretch carriage 106. In other embodiments, the stretch rollers 114 may not be driven, and instead only rotate when an external force pulls on the stretch film 104. In such an embodiment, the stretch rollers 114 may be operatively coupled through a series of gears or a similar mechanism configured to cause the outer surface of the second stretch roller 120 to move at a speed faster than a speed of the outer surface of the first stretch roller 118.

In some embodiments of the pallet wrapping system 100, the first stretch roller 118 and the second stretch roller 120 have the same diameter, as shown in FIG. 3. In such embodiments, the second stretch roller 120 rotates faster than the first stretch roller 118 for the outer surface of the second stretch roller 120 to have a higher speed than the outer surface of the first stretch roller 118. In other embodiments, however, the first stretch roller 118 may be configured with a diameter smaller than the diameter of the second stretch roller 120. In such an embodiment, the first stretch roller 118 and the second stretch roller 120 may be configured to rotate with the same rotational velocity and still have the outer surface of the second stretch roller 120 have a higher speed than the outer surface of the first stretch roller 118. Other ratios between the diameters of the first stretch roller 118 and the second stretch roll 120 are also possible.

The door 112 of the pre-stretch carriage 106 is configured to provide access to the stretch rollers 114 when the door 112 is in an opened position (see FIG. 2) and entrap the stretch film 104 between the stretch rollers 114 and the door 112 when the door 112 is in a closed position (see FIGS. 3 and 4). In some embodiments, the door 112 is hinged. The door 112 may have a hinge along a bottom of the pre-stretch carriage 106, and thus may move from the closed position to the open position by rotating down to expose the stretch rollers 114. The passive rollers 116 may be configured to move with the door 112. This allows the stretch film 104 to be easily threaded all the way through the pre-stretch carriage 106 without requiring feeding the stretch film 104 through any holes, gaps, or openings, as shown in FIG. 2.

The pallet wrapping system 100 also comprises at least two encoders 122 including a first encoder 124 and a second encoder 126. The encoders 122 may be mounted on the door 112. By mounting the encoders 122 on the door 112, the encoders 122 are automatically disengaged whenever the door 112 is opened, thus preventing the need for the operator or user to remember to disengage or engage the encoder 122. By limiting the need for user involvement, the risk of error is reduced.

Any type of encoder 122 capable of measuring a length of stretch film 104 passing the encoder 122 may be used. As a particular example, the encoders 122 may be rotary encoders, such as mechanical, magnetic, resistive, or optical encoders, etc. In such an embodiment, the encoders 122 may be configured to contact the stretch film 104 as the stretch film 104 passes through the pallet wrapping system 100. As the stretch film 104 passes each encoder 122, the encoder 122 rotates and measures the amount of rotation. The amount of rotation can then be used with known values such as the radius of the encoder 122 to calculate the length of stretch film 104 that passed the encoder 122. Different locations along the path of the stretch film 104 may provide different measurements useful to the user. For example, an encoder 122 positioned to contact the stretch film 104 as the stretch film 104 passes over the first stretch roller 118 provides the length of stretch film 104 removed from the roll 110 of stretch film 104, while an encoder 122 positioned to contact the stretch film 104 as the stretch film 104 passes over the second stretch roller 120 provides the length of stretch film 104 exiting the pre-stretch carriage 106.

The first encoder 124 may be configured to configured to measure a length of stretch film 104 passing over the first stretch roller 118. This measurement helps the user to know the length of stretch film 104 being removed from the roll 110 of stretch film 104 per pallet. To obtain this measurement, the first encoder 124 may be configured to contact the stretch film 104 on the outer surface of the first stretch roller 118 when the door 112 is in the closed position. This allows the first encoder 124 to obtain an accurate measurement of the length of stretch film 104 removed from the roll 110 by decreasing any slipping between the stretch film 104 and the first stretch roller 118. The first encoder 124 may additionally be spring loaded to push the stretch film 104 against the outer surface of the first stretch roller 118 when the door 112 is in the closed position. The second encoder 126 may be configured to measure a length of stretch film 104 passing over the second stretch roller 120. This measurement helps the user to know the length of stretch film 104 exiting the pre-stretch carriage, which in turn helps the user to know the amount of pre-stretch applied by the pre-stretch carriage through a comparison of the measurements taken by the first encoder 124 and the second encoder 126. To obtain this measurement, the second encoder 126 may be configured to contact the stretch film 104 on the outer surface of the second stretch roller 120 when the door 112 is in the closed position. This allows the second encoder 126 to obtain an accurate measurement of the length of stretch film leaving the pre-stretch carriage 106 by decreasing any slipping between the stretch film 104 and the second stretch roller 120. The second encoder 126 may additionally be spring loaded to push the stretch film 104 against the outer surface of the second stretch roller 120 when the door 112 is in the closed position. In some embodiments, the first encoder 124 is configured to rotate when the stretch film 104 passes over the first stretch roller 118 and the second encoder 126 is configured to rotate when the stretch film 104 passes over the second stretch roller 120. However, in other embodiments, the encoders 122 are not configured to rotate, and instead measure a distance or length passing the encoder 122 using a different method.

As mentioned above, the encoders 122 may be mounted on the door 112 of the pre-stretch carriage 106. The positioning of the encoders 122 is important. When the encoders 122 are placed in other positions, such as against the roll 100 of stretch film 104, the user must remember to engage the encoders 122 prior to use. Often, this step is forgotten and the pallet wrapping system 100 is unable to track the stretch film usage. In addition, when the encoders 122 are placed outside of the pre-stretch carriage 106, the encoders 122 are easily damaged by other equipment. Thus, by placing the encoders 122 inside of the pre-stretch carriage 106, the encoders 122 are protected from damage by other equipment, and automatically reset and ready to track stretch film usage when the door 112 is closed. No additional steps must be taken by the user. Additionally, placing the encoders 122 inside of the pre-stretch carriage 106 increases the accuracy of measurements and allows the path between the encoders 122 to be opened for inserting the stretch film 104 and closed reliably without affecting the encoders 122 or their operational stability.

Figure 5:
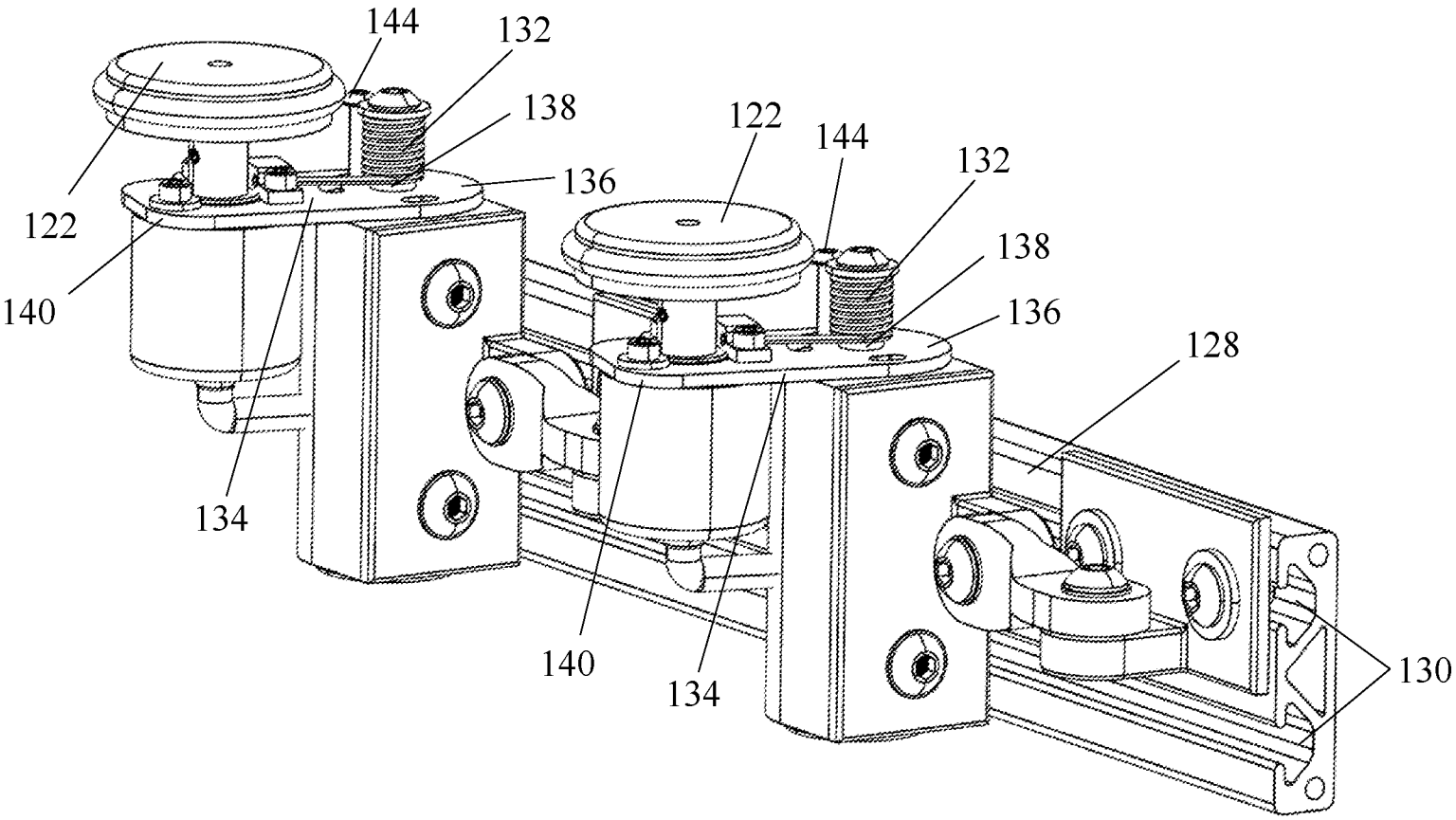
FIG. 5 is a close-up perspective view of the mounting bracket for mounting the encoders to the door of the pre-stretch carriage shown in FIG. 1.
Figure 6:
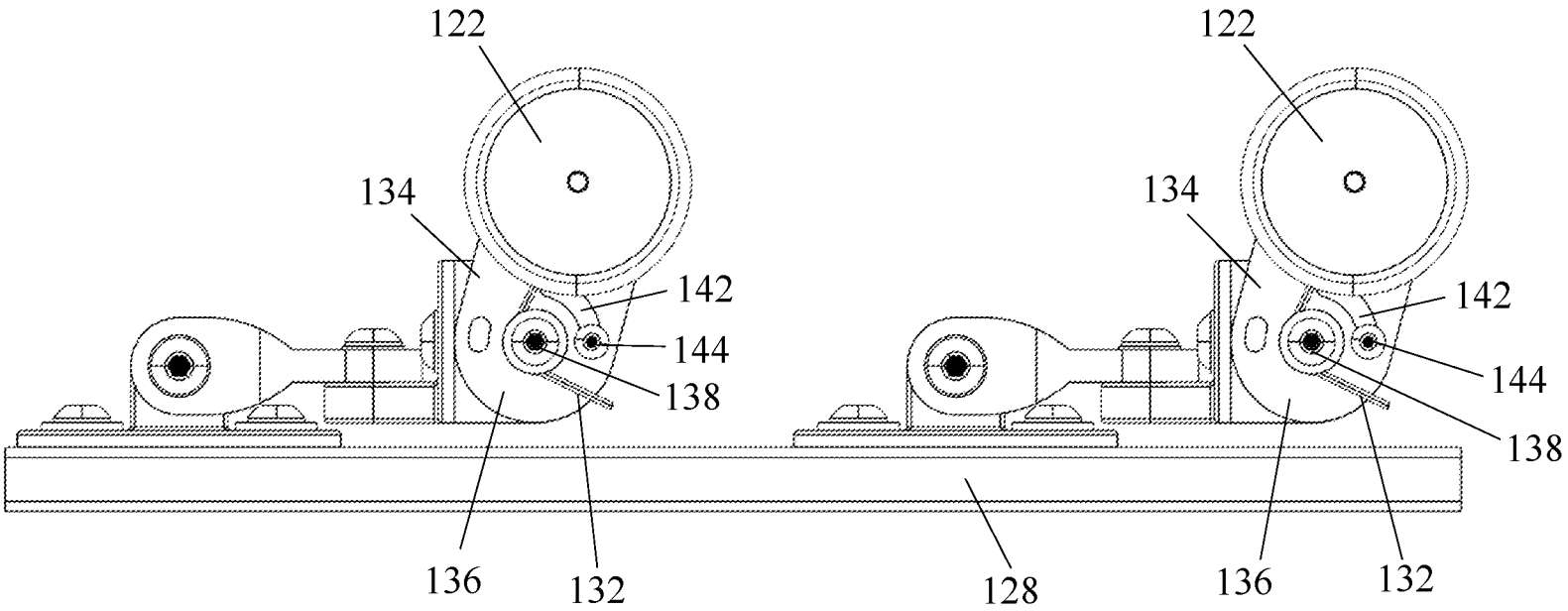
FIG. 6 is a top view of the mounting bracket and encoders shown in FIG. 5.

As shown in FIGS. 5-6, the encoders 122 may be mounted to the door 112 of the pre-stretch carriage 106 using a mounting bracket 128. The mounting bracket 128 may have a plurality of horizontal slots 130 to accommodate the precise positioning of the encoders 122 for optimal contact with the stretch rollers 114. In addition, the encoders 122 may each be movable towards and away from the door 112. The mounting bracket 128 may have a spring 132 coupled with each of the encoders 122 that is configured to bias the encoders 122 away from the door 112. The spring 132 may be a torsion spring as shown in FIGS. 5-6. Other springs, such as linear springs, may also be used. In some embodiments, the mounting bracket 128 has a pivot arm 134 for each of the encoders 122. The pivot arm 134 has a first end 136 with a pivot point 138 around which the pivot arm 134 is configured to rotate. The pivot arm 134 also has a second end 140 distal to the first end 136. The encoder 122 may be coupled to the second end 140 of the pivot arm 134. As shown in FIG. 6, the pivot arm 134 may have a track 142 configured to allow the pivot arm 134 to rotate about the pivot point 138. A stop 144 may extend up through the track 142. Although the spring 132 is shown in a position with no stored energy, to function, the spring 132 must be engaged with the stop 144. By engaging the spring 132 with the stop 144, the encoder 122 is biased away from the mounting bracket 128 and the door 112. This bias increases the force with which the encoder 122 presses against the stretch roller 114 when the door 112 is in the closed position, and thus decreases slippage between the stretch film 104 and the encoder 122 and improves the accuracy of the measurements taken by the encoder 122.

By placing the sensors for tracking the stretch film usage within the pre-stretch carriage 106, the pallet wrapping system 100 as disclosed herein is able to accurately track stretch film usage while limiting user involvement. In addition, the pallet wrapping system 100 is able to provide detailed information regarding the pre-stretch and how well the palletized loads 102 are wrapped based on the measurements taken by the encoders 122. Thus, the pallet wrapping system 100 improves upon traditional systems for tracking stretch film usage.

It will be understood that implementations of a pallet wrapping system are not limited to the specific assemblies, devices and components disclosed in this document, as virtually any assemblies, devices and components consistent with the intended operation of a pallet wrapping system may be used. Accordingly, for example, although particular pallet wrapping systems, and other assemblies, devices and components are disclosed, such may include any shape, size, style, type, model, version, class, measurement, concentration, material, weight, quantity, and/or the like consistent with the intended operation of pallet wrapping systems. Implementations are not limited to uses of any specific assemblies, devices and components; provided that the assemblies, devices and components selected are consistent with the intended operation of a pallet wrapping system.

Accordingly, the components defining any pallet wrapping system may be formed of any of many different types of materials or combinations thereof that can readily be formed into shaped objects provided that the materials selected are consistent with the intended operation of a pallet wrapping system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various pallet wrapping systems may be manufactured using conventional procedures as added to and improved upon through the procedures described here. Some components defining a pallet wrapping system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling pallet wrapping systems are not limited to the specific order of steps as disclosed in this document. Any steps or sequence of steps of the assembly of a pallet wrapping system indicated herein are given as examples of possible steps or sequence of steps and not as limitations, since various assembly processes and sequences of steps may be used to assemble pallet wrapping systems.

The implementations of a pallet wrapping system described are by way of example or explanation and not by way of limitation. Rather, any description relating to the foregoing is for the exemplary purposes of this disclosure, and implementations may also be used with similar results for a variety of other applications employing a pallet wrapping system.

What is claimed is:

1. A pallet wrapping system, comprising:

a pre-stretch carriage configured to pre-stretch stretch film, the pre-stretch carriage having:

at least two driven stretch rollers including a first driven stretch roller with an outer surface configured to move at a first speed and a second driven stretch roller with an outer surface configured to move at a second speed higher than the first speed; and a hinged door configured to provide access to the at least two driven stretch rollers when in an open position and entrap the stretch film between the at least two driven stretch rollers and the hinged door when in a closed position; and at least two encoders including a first encoder and a second encoder mounted on the hinged door, wherein the first encoder is configured to contact the stretch film on the outer surface of the first driven stretch roller when the hinged door is in the closed position and measure a length of the stretch film passing over the first driven stretch roller, and wherein the second encoder is configured to contact the stretch film on the outer surface of the second driven stretch roller when the hinged door is in the closed position and measure a length of the stretch film passing over the second driven stretch roller.

2. The pallet wrapping system of claim 1, wherein the first driven stretch roller has a diameter smaller than a diameter of the second driven stretch roller.

3. The pallet wrapping system of claim 1, wherein the first driven stretch roller has a diameter equal to a diameter of the second driven stretch roller.

4. The pallet wrapping system of claim 1, wherein the first encoder is configured to rotate when the stretch film passes over the first driven stretch roller, and the second encoder is configured to rotate when the stretch film passes over the second driven stretch roller.

5. A pallet wrapping system, comprising:

a pre-stretch carriage configured to pre-stretch stretch film, the pre-stretch carriage having:

at least two driven stretch rollers including a first driven stretch roller with an outer surface configured to move at a first speed and a second driven stretch roller with an outer surface configured to move at a second speed higher than the first speed; and a door configured to provide access to the at least two driven stretch rollers when in an open position and entrap the stretch film between the at least two driven stretch rollers and the door when in a closed position; and at least two encoders including a first encoder and a second encoder mounted on the door, wherein the first encoder is configured to measure a length of the stretch film passing over the first driven stretch roller while the door is in the closed position, and wherein the second encoder is configured to measure a length of the stretch film passing over the second driven stretch roller while the door is in the closed position.

6. The pallet wrapping system of claim 5, wherein each of the at least two encoders is movable towards and away from the door and is biased away from the door.

7. The pallet wrapping system of claim 5, wherein the first encoder is configured to contact the stretch film on the outer surface of the first driven stretch roller when the door is in the closed position.

8. The pallet wrapping system of claim 5, wherein the second encoder is configured to contact the stretch film on the outer surface of the second driven stretch roller when the door is in the closed position.

9. The pallet wrapping system of claim 5, wherein the first driven stretch roller has a diameter smaller than a diameter of the second driven stretch roller.

10. The pallet wrapping system of claim 5, wherein the first driven stretch roller has a diameter equal to a diameter of the second driven stretch roller.

11. The pallet wrapping system of claim 5, wherein the first encoder is configured to rotate when the stretch film passes over the first driven stretch roller, and the second encoder is configured to rotate when the stretch film passes over the second driven stretch roller.

12. A pallet wrapping system, comprising:

a pre-stretch carriage configured to pre-stretch stretch film, the pre-stretch carriage having:

at least one stretch roller including a first stretch roller with an outer surface configured to move at a first speed; and a door configured to provide access to the at least one stretch roller when in an open position and entrap the stretch film between the at least one stretch roller and the door when in a closed position; and at least one encoder including a first encoder mounted on the door, wherein the first encoder is configured to measure a length of the stretch film passing over the first stretch roller while the door is in the closed position, and wherein each of the at least one encoder is movable towards and away from the door and is biased away from the door.

13. The pallet wrapping system of claim 12, wherein the first encoder is configured to contact the stretch film on the outer surface of the first stretch roller when the door is in the closed position.

14. The pallet wrapping system of claim 12, wherein the first encoder is configured to rotate when the stretch film passes over the first stretch roller.

15. The pallet wrapping system of claim 12, the at least one stretch roller further including a second stretch roller with an outer surface configured to move at a second speed higher than the first speed.

16. The pallet wrapping system of claim 15, wherein the first stretch roller has a diameter smaller than a diameter of the second stretch roller.

17. The pallet wrapping system of claim 15, wherein the first stretch roller has a diameter equal to a diameter of the second stretch roller.

18. The pallet wrapping system of claim 15, the at least one encoder further including a second encoder, wherein the second encoder is configured to measure a length of the stretch film passing over the outer surface of the second stretch roller while the door is in the closed position.

19. The pallet wrapping system of claim 18, wherein the second encoder is configured to contact the stretch film on the outer surface of the second stretch roller when the door is in the closed position.

* * * * *